US009260790B2

(12) United States Patent
Palumbo et al.

(10) Patent No.: US 9,260,790 B2
(45) Date of Patent: Feb. 16, 2016

(54) METHOD FOR PREPARING POLYCRYSTALLINE STRUCTURES HAVING IMPROVED MECHANICAL AND PHYSICAL PROPERTIES

(75) Inventors: Gino Palumbo, Toronto (CA); Iain Brooks, Toronto (CA); Klaus Tomantschger, Mississauga (CA); Peter Lin, Toronto (CA); Karl Aust, Toronto (CA); Nandakumar Nagarajan, Burlington (CA); Francisco Gonzalez, Toronto (CA)

(73) Assignee: INTEGRAN TECHNOLOGIES INC., Mississauga, Ontario (CA)

( * ) Notice: Subject to any disclaimer, the term of this patent is extended or adjusted under 35 U.S.C. 154(b) by 1203 days.

(21) Appl. No.: 12/808,697

(22) PCT Filed: Dec. 18, 2008

(86) PCT No.: PCT/CA2008/002265

§ 371 (c)(1),
(2), (4) Date: Aug. 11, 2010

(87) PCT Pub. No.: WO2009/076777

PCT Pub. Date: Jun. 25, 2009

(65) Prior Publication Data

US 2010/0307642 A1 Dec. 9, 2010

Related U.S. Application Data

(60) Provisional application No. 61/014,448, filed on Dec. 18, 2007.

(51) Int. Cl.

| | |
|---|---|
| ***C25D 5/50*** | (2006.01) |
| *C25D 3/12* | (2006.01) |
| *C25D 3/38* | (2006.01) |

(52) U.S. Cl.
CPC .. *C25D 5/50* (2013.01); *C25D 3/12* (2013.01); *C25D 3/38* (2013.01)

(58) Field of Classification Search
CPC ..... C25D 5/50; C25D 3/12; C25D 3/38
USPC ..... 148/400, 518
See application file for complete search history.

(56) References Cited

U.S. PATENT DOCUMENTS 3,790,451 A * 2/1974 Weisenberger et al. ..... 205/103
4,766,813 A 8/1988 Winter et al.

(Continued)

FOREIGN PATENT DOCUMENTS

EP 1798314 A1 6/2007
JP 57-167568 A 10/1982
WO 00/48758 8/2000

OTHER PUBLICATIONS

G. Palumbo, et. al., Atomic Level Structure and Properties, Ch. 5; Material Interfaces, pp. 190-211 eds. D. Wolf and S. Yip, Chapman and Hall, New York (1992)

D.G. Brandon, "The Structure of High-Angle Grain Boundaries", Acta Metallurgica, vol. 14, pp. 1479-1484 (Nov. 1966), Geneva, Switzerland. .

(Continued)

*Primary Examiner* — Rebecca Lee
(74) *Attorney, Agent, or Firm* — Bacon & Thomas, PLLC

(57) ABSTRACT

Polycrystalline materials are prepared by electrodeposition of a precursor material that is subsequently heat-treated to induce at least a threefold increase in the grain size of the material to yield a relatively high fraction of 'special' low Σ grain boundaries and a randomized crystallographic texture. The precursor metallic material has sufficient purity and a fine-grained microstructure (e.g., an average grain size of 4 nm to 5 μm). The resulting metallic material is suited to the fabrication of articles requiring high mechanical or physical isotropy and/or resistance to grain boundary-mediated deformation or degradation mechanisms.

8 Claims, 7 Drawing Sheets

(56) References Cited

U.S. PATENT DOCUMENTS

| | | | | |
|---|---|---|---|---|
| 5,702,543 | A | 12/1997 | Palumbo | |
| 5,817,193 | A | 10/1998 | Palumbo | |
| 6,129,795 | A * | 10/2000 | Lehockey et al. | 148/608 |
| 6,132,887 | A * | 10/2000 | Clouser et al. | 428/606 |
| 6,309,529 | B1 | 10/2001 | Hara et al. | |
| 6,344,097 | B1 | 2/2002 | Limoges et al. | |
| 6,709,564 | B1 | 3/2004 | Tench et al. | |
| 2004/0241487 | A1 * | 12/2004 | Nagatani | 428/606 |
| 2006/0292388 | A1 * | 12/2006 | Palumbo et al. | 428/586 |
| 2007/0012576 | A1 | 1/2007 | Binstead et al. | |

OTHER PUBLICATIONS

E.G. Doni, et. al., Computer Simulation of Triple Line Character Distributions in FCC Materials, Scripta Metallurgica et Materialia, vol. 24, pp. 2325-2328, (1990).

D.H. Warrington, et. al., Ordered Structures in Random Grain Boundaries: Some Geometrical Propabilities, Acta Metallurgica, vol. 23, pp. 599-607, (1975).

Search Report from the European Patent Office (EPO) for European Patent Application EP 08 86 1084.5, dated Mar. 1, 2012, (9 pages).

* cited by examiner

METHOD FOR PREPARING POLYCRYSTALLINE STRUCTURES HAVING IMPROVED MECHANICAL AND PHYSICAL PROPERTIES

CROSS REFERENCE TO RELATED APPLICATIONS

Under 35 U.S.C. §119(e) this application claims the benefit of U.S. Provisional Application No. 61/014,448 filed Dec. 18, 2007, which is hereby incorporated by reference in its entirety.

FIELD

This specification relates to methods of producing polycrystalline materials having improved mechanical and physical properties. This specification also relates to grain boundary engineering, electrodeposition and heat-treatment.

INTRODUCTION

The following paragraphs are not an admission that anything discussed in them is prior art or part of the knowledge of persons skilled in the art.

Intergranular degradation processes (e.g., fatigue, creep and corrosion) can be principal causes of premature and unpredictable service failure of normally ductile engineering materials. Intergranular degradation processes occur at grain boundaries and can lead to component failure via propagation through the intercrystalline network. Intergranular degradation processes can therefore be governed by specific grain boundary structure, grain boundary chemistry (i.e. solute segregation and precipitation), and grain size and shape (i.e. connectivity).

Grain boundaries crystallographically described by low Σ (i.e. $\Sigma \leq 29$) Coincidence Site Lattice (CSL) relationships can possess more ordered structures, can be less prone to solute interaction, and can display a resistance and sometimes even immunity to intergranular corrosion, intergranular sliding, cavitation, and fracture (see G. Palumbo and K. T. Aust, in Materials Interfaces: Atomic Level Structure and Properties, eds. D. Wolf, and S. Yip, Chapman and Hall, New York (1992) 190-211). A grain boundary is termed 'special' if its interfacial crystallography lies within an acceptable range Δθ of Σ, where $\Sigma \leq 29$, and $\Delta\theta = 15\Sigma^{-1/2}$ as defined by Brandon, Acta Metall., 34, 1479 (1966).

Recent advances in automated crystallographic orientation imaging microscopy (OIM) have made it possible to readily determine the distributions of these 'special' low Σ (≤29) grain boundaries in conventional polycrystalline materials. This then can allow for the optimization of material processing techniques in order to enhance the overall population of low Σ grain boundaries to effect intergranular degradation-resistant microstructures, and the stochastic evaluation of the intrinsic reliability of resulting components and structures.

U.S. Pat. No. 5,702,543 to Palumbo describes thermomechanical processing of metallic materials, namely, in the fabrication of components from a face centered cubic alloy, wherein the alloy is cold worked and annealed, the cold working is carried out in a number of separate steps, each step being followed by an annealing step. The resultant product has a grain size not exceeding 30 microns, a 'special' grain boundary fraction not less than 60%, and major crystallographic texture intensities all being less than twice that of random values. The product has an enhanced resistance to intergranular degradation and stress corrosion cracking, and possesses highly isotropic bulk properties.

U.S. Pat. No. 6,129,795 to Lehockey et al. describes a metallurgical method for improving the microstructure of nickel and iron-based precipitation strengthened superalloys used in high temperature applications by increasing the frequency of 'special', low Σ CSL grain boundaries to levels in excess of 50%. Processing entails applying specific thermomechanical processing sequences to precipitation hardenable alloys comprising a series of cold deformation and recrystallization-annealing steps performed within specific limits of deformation, temperature, and annealing time. Materials produced by this process exhibit improved resistance to high temperature degradation (e.g., creep, hot corrosion, etc.), enhanced weldability, and high cycle fatigue resistance.

U.S. Pat. No. 6,344,097 to Limoges et al. discloses a surface treatment process for enhancing the intergranular corrosion and intergranular cracking resistance of components fabricated from austenitic Ni—Fe—Cr based alloys comprised of the application of surface cold work to a depth in the range of 0.01 mm to 0.5 mm, for example by high intensity shot peening, followed by recrystallization heat treatment preferably at solutionizing temperatures (>900° C.). The surface cold work and annealing process can be repeated to further optimize the microstructure of the near-surface region. Following the final heat treatment, the process can optionally comprise the application of surface cold work of reduced intensity, yielding a cold worked depth of 0.005 mm to 0.01 mm, in order further enhance resistance to cracking by rendering the near surface in residual compression.

SUMMARY

In an aspect of this specification, a method of preparing an article having improved properties can comprise the steps of: electrodepositing a metallic material to form or at least partially plate an article, the metallic material having an average grain size between about 4 nm and 5 μm, and an impurity content of less than 20 ppm by weight of S, less than 50 ppm by weight of O, less than 50 ppm by weight of P, and less than 300 ppm by weight of C; and heat-treating the electrodeposited metallic material at a temperature between about 0.25 $T_m$ and 0.7 $T_m$ K for a period of time sufficient to induce grain growth in the metallic material such that at least a portion of the metallic material exhibits an increase of at least 0.3 in special grain boundary fraction and a crystallographic texture intensity value less than 7.5 times random.

In another aspect of this specification, a method of preparing an article having improved properties can comprise the steps of: electrodepositing a metallic material comprising Cu to form or at least partially plate an article, the metallic material having an average grain size between about 4 nm and 5 μm, and an impurity content of less than 20 ppm by weight of S, less than 50 ppm by weight of O, less than 50 ppm by weight of P, and less than 300 ppm by weight of C; and heat-treating the electrodeposited metallic material at a temperature between about 0.25 $T_m$ and 0.7 $T_m$ K for a period of time sufficient to induce grain growth in the metallic material such that at least a portion of the metallic material exhibits an increase of at least 0.3 in special grain boundary fraction and a crystallographic texture intensity less than 7.5 times random.

In yet another aspect of this specification, an article can be provided comprising a heat-treated electrodeposited fine grained substantially pure metallic material having a crystallographic texture intensity value of less than 7.5 times random and a special grain boundary content of at least 50%.

These and other features of the applicant's teachings are set forth herein.

DRAWINGS

The skilled person in the art will understand that the drawings, described below, are for illustration purposes only. The drawings are not intended to limit the scope of the applicant's teachings in any way.

DESCRIPTION OF VARIOUS EMBODIMENTS

Figure 2:
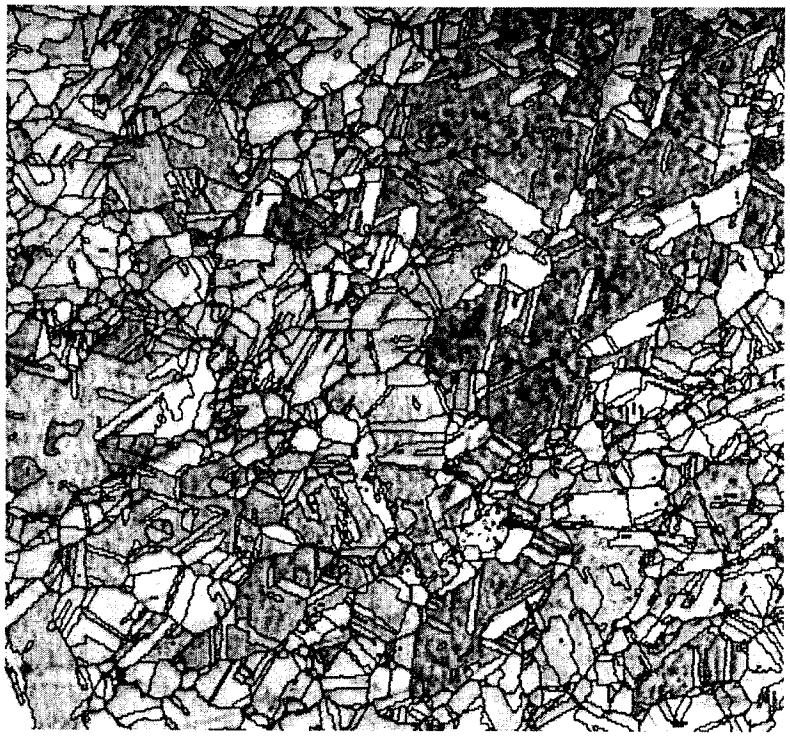
FIG. 2 is an Orientation Imaging Microscopy (OIM) micrograph of an electrodeposited copper microstructure after grain growth heat-treatment, in accordance with Example 2 described in this specification.

Various apparatuses or methods will be described below to provide an example of an embodiment of each claimed invention. No embodiment described below limits any claimed invention and any claimed invention may cover apparatuses or methods that are not described below. The claimed inventions are not limited to apparatuses or methods having all of the features of any one apparatus or method described below or to features common to multiple or all of the apparatuses described below. One or more inventions may reside in a combination or sub-combination of the apparatus elements or method steps described below or in other parts of this document. It is possible that an apparatus or method described below is not an embodiment of any claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

Applicant's teachings relate to the application of deliberate, controlled grain growth heat-treatment of relatively fine-grained, sufficiently pure electrodeposited metallic materials to increase the 'special' grain boundary fraction ($f_{sp}$) by at least 30% (0.3) over the as-plated material and to create a crystallographically randomized polycrystalline microstructure. Polycrystalline materials prepared in accordance with applicant's teachings can possess enhanced resistance to intergranular degradation and exhibit improved mechanical and physical isotropy.

The desired increase in the 'special' grain boundary fraction can be mathematically expressed as $f_{sp,2}-f_{sp,1}>0.3$, where $f_{sp,2}$ is the 'special' grain boundary fraction after grain growth heat-treatment and $f_{sp,1}$ is the 'special' grain boundary fraction of the precursor material before grain growth heat-treatment. In some examples, the desired increase (or $\Delta f_{sp}$) in the 'special' grain boundary fraction can be more than 0.4. Heat treatment can obtain metallic materials having a total special grain boundary content of at least 50%, and in some cases more than 70%. Furthermore, heat-treatment can obtain metallic materials having a maximum crystallographic texture intensity of less than 7.5 times random and preferably less than five times random.

Deliberate formation of polycrystalline microstructures rich in 'special' grain boundaries via conventional thermo-mechanical processing-based methods has been based on the knowledge that selective recrystallization induced at the most highly defective grain boundary sites in the microstructure of a deformed polycrystalline metallic material results in a high probability of continual replacement of high energy disordered grain boundaries, with those having greater atomic order approaching that of the crystal lattice itself. Applicant's teachings relate to the creation of randomly oriented polycrystalline materials that exhibit enhanced mechanical and physical properties by virtue of their possessing a high fraction of degradation-resistant 'special' low $\Sigma$ ($\Sigma\leq29$) CSL interfaces between the materials' constituent crystals. The inventors have realized that microstructural optimization can be achieved by the heat-treatment of sufficiently pure, fine-grained polycrystalline precursor metallic materials without the application of deformation.

The replacement of high energy disordered 'general' ($\Sigma>29$) grain boundaries with low energy 'special' ($\Sigma\leq29$) grain boundaries having atomic order approaching that of the crystal lattice itself can be accompanied by a decrease in preferred crystallographic orientation of the material. The term 'randomized crystallographic texture' is defined herein as a polycrystalline microstructure wherein no single crystallographic orientation is observed at a frequency greater than 7.5 times (and preferably 5 times) its occurrence in a sample with a completely random distribution of crystals. This is expressed as a Texture Intensity (TI) value and so a completely random agglomeration of crystals would exhibit a TI value of unity while a crystallographically randomized sample for the purposes of this disclosure would exhibit a TI<7.5 and preferably <5. Crystallographically randomized materials are substantially isotropic.

Randomized crystallographic texture and high $f_{sp}$ can be achieved by controlled grain growth via heat-treatment of an initially fine-grained (≤5 μm grain size) polycrystalline precursor material. The relatively small grain size of the precursor material provides a significant driving force for grain growth to occur during heat-treatment.

The precursor to the heat-treatment can be a metal or alloy possessing an initially fine-grained microstructure, and can consist substantially of a cubic structured material (for example but not limited to Cu, Ni, Fe and their alloys). Fine-grained in this context is defined as having an average grain size that ranges from about 4 nm to 5 μm, a grain size range which is below the typical grain size range of commonly used engineering alloys.

It has been unexpectedly found that fine-grained materials produced by electrodeposition (including electroplating or electroforming) can be well suited as precursors because grain growth can be induced without having to subject the materials to plastic deformation and primary recrystallization prior to grain growth. Recrystallization and grain growth are two basically different phenomena insofar as grain growth is defined as the consumption of smaller crystals by energetically preferred larger crystals whereas the term 'recrystallization' is defined as the organization of dislocations into low energy configurations (intergranular "cell" walls or "subgrain" boundaries) which eventually form distinct grain boundaries themselves.

Fine-grained polycrystalline metals and alloys possess a strong thermodynamic potential for microstructural transformation through grain growth. Concurrently, strong thermodynamic potential also exists for the segregation of co-deposited impurity elements at grain boundaries. This segregation can lower the grain boundary energy and effectively destroy the energy difference between 'special' and 'general' boundaries. Therefore, it is preferable that the precursor material is sufficiently free of impurities that could result in deleterious solute segregation, undesirable second phase precipitation, grain boundary pinning effects and/or other material embrittlement mechanisms during the grain growth stage of processing. For some examples, specific impurity elements and the corresponding concentration levels expressed on a weight basis at which they are deemed to be deleterious are ≥20 ppm S, ≥50 ppm P, ≥50 ppm O, and ≥300 ppm C.

Fabrication of high purity polycrystalline solids exhibiting average grain size values below 5 μm can be difficult to achieve via traditional metallurgical means, which typically yield grain sizes in the range of 30 to 500 μm. This is because most traditional metallurgical processing techniques operate at or near equilibrium, where the formation of coarse grains larger than 5 μm in diameter is energetically preferred. In order to form non-equilibrium fine-grained structures, synthesis techniques may rely upon mechanisms that involve undesirable chemical contamination of the matrix material. An example of this phenomenon is the use of organic and/or inorganic grain refiners in electroplating. These electrolyte additives assist in the formation of highly non-equilibrium, fine-grained or amorphous structures, but invariably become codeposited along with the metal being reduced, resulting in excessively high concentrations of deleterious impurity elements, for example but not limited to, S, O, C, N, H, and P. Electrodeposition (including electroplating or electroforming) can be used to create the precursor material if the desired metal reduction is carried out in such a way that it is not accompanied by an excessive quantity of undesirable impurities.

In accordance with various embodiments of the applicant's teachings, the formation of fine-grained microstructure can take place as a result of some other structural refinement mechanism that predominates in an electrolyte that is sufficiently free of impurity-containing constituents. One example is the electrodeposition of fine-grained, relatively high purity copper from pyrophosphate-based electrolytes. Via selection of solution chemistry constituents and plating process parameters, fine-grained pure copper can be electrodeposited with a very low concentration of the impurity elements of concern, as presented in Table 1 below where chemical assay results from a typical fine-grained highly pure copper sample from the pyrophosphate electrolyte are compared with benchmark results from copper electrodeposited from the widely used acid sulfate bath containing polyethylene glycol and conventional pyrometallurgically prepared "oxygen free high conductivity" (OFHC) grade copper.

TABLE 1

Properties of High Purity Fine-Grained Electrodeposited Cu, Conventional Purity Fine-Grained Electrodeposited Cu and Conventional Pyrometallurgically Prepared "Oxygen Free High Conductivity" (OFHC) Cu Benchmark Material.

| Material Description | Processing Route | Grain Size (microns) | [S] ppm | [C] ppm | [O] ppm | [N] ppm | [H] ppm | [P] ppm |
|---|---|---|---|---|---|---|---|---|
| Pyro Cu | Electrodeposition | 0.2 | 8.8 | 121 | <50 | <50 | 3 | <50 |
| Acid Sulfate + PEG Cu | Electrodeposition | 0.8 | 15.6 | 404 | 330 | <50 | 45 | <50 |
| OFHC Cu benchmark | Cast | >20 | 14.8 | 100 | <50 | <50 | <50 | <50 |

In this case, grain refinement into the "fine" regime has been accomplished without chemical contamination in excess of that specified by the precursor material purity requirement described earlier. Hence, one aspect of the applicant's teachings is the selection of a precursor material production technique that achieves the requisite level of grain refinement without any reliance upon deleterious impurity-containing processing constituents to do so.

Ultimately, the exact concentration at which such elements become harmful is dependent both upon the matrix chemistry and the embrittlement capability of the impurity element. For instance, sulfur can be a powerful embrittling agent in nickel-based alloys, and should be maintained at levels below approximately 100 ppm, and preferably below 20 ppm. In the case of copper, the mechanical and physical properties are known to be sensitive to the oxygen concentration, hence the widespread use of OFHC ("Oxygen Free High Conductivity") copper, which typically specifies an oxygen content of less than 50 ppm, in industrial applications where the copper is subjected to heating. While the applicant does not wish to be bound by theory, it is believed that since grain boundaries have a tendency to segregate or "sweep up" impurities during grain growth, any and all grain boundary pinning and embrittlement mechanisms that become active during the heat-treatment stage of processing should be minimized.

While the chemical composition of the precursor material is a factor with respect to avoidance of grain boundary embrittlement effects upon grain growth heat-treatment, it is to be understood that the scope of the applicant's teachings is not limited in any way by the concentration of those elements that do not result in grain boundary pinning or embrittlement of the precursor material upon grain growth heat-treatment. In other words, sufficiently pure metals and alloys of two or more elements are equally suitable for application as a precursor material for the metallurgical processing methodology disclosed herein.

The grain growth heat-treatment temperature and/or time range can be selected to ensure that the intended microstructural evolution takes place without excessive grain growth, that is to say, for example, so that the average grain size of the material after heat-treatment will not exceed 50 μm.

In some examples, the grain growth heat-treatment can be a conventional metallurgical heat treatment carried out in a controlled manner within the range of 0.25 to 0.7 of $T_m$ K, the homologous melting temperature of the metal or alloy in question, for a period of time sufficient to induce at least a threefold increase in the grain size of the material, generally between 1 second and 75 hours. It should be appreciated that if a polycrystalline material with a starting grain size of d grows such that each grain boundary has migrated by a distance of one grain diameter, then the grain size of this material will be 3 d. Thus, the minimum dimensional change a grain will experience if all of its grain boundaries migrate one grain diameter is a threefold increase.

Heat-treatment under optimum temperature and time conditions results in a microstructure with improved preferred crystallographic orientation and 'special' grain boundary content approaching optimum conditions. In the case of the crystallographic orientation, the optimum condition is defined as a fully random texture defined as a texture intensity value of one times random (TI=1). In the case of the special grain boundary content, the highest $f_{sp}$ obtainable is 100% ($f_{sp}$=100%). The grain growth heat-treatment temperature and time conditions according to the applicant's teachings are selected to maximize the $f_{sp}$ and/or minimize the texture intensity.

In some examples, the fine-grained precursor materials can be produced via electrodeposition using an aqueous electrolyte. In some particular examples, electrolytic deposition of the precursor material can be carried out using direct current (DC), pulsed current plating (PP) and/or pulse reverse (PR) plating, the electrodeposition parameters being average current density ranging from 5 to 10,000 mA/cm$^2$, forward pulse on time ranging from 0.1 to 500 ms, pulse off time ranging from 0 to 10,000 ms, reverse pulse on time ranging from 0 to 500 ms, peak forward current density ranging from 5 to 10,000 mA/cm$^2$, peak reverse current density ranging from 5 to 20,000 mA/cm$^2$, frequency ranging from 0 to 1,000 Hz, and a duty cycle ranging from 5 to 100% (see teachings of Erb in U.S. Pat. No. 5,352,266 (1994) and U.S. Pat. No. 5,433,797 (1995) and Palumbo in United States Patent Publication No. 20050205425, all of which are hereby incorporated by reference in their entirety).

Electrodeposition as discussed herein can include either electroforming for the preparation of whole components comprising a bulk metallic material, as well as electroplating for cases where metallic material is deposited as a coating on a substrate. However, it is to be understood that the applicant's teachings should not be limited by the precursor material forming technique and that, in principle, any forming method that is suitable for the production of undeformed fine-grained metals and alloys can be employed. Other than electrodeposition techniques described herein, it should be appreciated that the precursor material can be formed from a variety of synthesis techniques, including, for example but not limited to, electrolytic deposition, electroless deposition, inert gas condensation (IGC), physical vapour deposition (PVD), chemical vapour deposition (CVD), pulsed laser deposition, and sol-gel processing.

It is preferable that the surfaces of the fine-grained precursor material not pin the desired grain growth and thereby impede the development of the desired microstructure. In order for this to be the case, the minimum acceptable material thickness may be related to its average grain size and, as described earlier, a threefold increase in diameter is the minimum dimensional change a grain experiences if all of its grain boundaries are to migrate a distance of at least one grain diameter. This defines the minimum permissible average grain size increase that may be required to achieve widespread replacement of 'general' grain boundaries by 'special' grain boundaries, as desired. It is conceivable that the free surfaces of a material begin to impede grain growth once the grain size reaches one tenth the material layer thickness and it is therefore preferable, in some examples, that the material layer thickness exceeds (3×10)d=30 d where d represents the initial average grain size of the precursor material.

Applicant's teachings are particularly suited to the fabrication of articles whose performance is influenced in some way by grain boundary-mediated deformation or degradation mechanisms such as high strain rate ductility, intergranular corrosion, intergranular stress corrosion cracking, creep, high-cycle fatigue, precipitation embrittlement, and fracture originating from cracks whose propagation is dependent upon the presence of active intergranular paths.

In some particular examples, metallic articles produced in accordance with the applicant's teaching can be used as shaped charge liners. Generally speaking, electroformed metals or alloys may not satisfy the demands for use as shaped charge liners because they are subject to impurity contamination which results in deleterious material embrittlement and commensurately poor performance of the component in service. These impurities can often be inherent to the process and originate from electroplating bath additives used to achieve deposit brightness, grain refinement, leveling/smoothness, chelating effects, hydrogen gas bubble elimination, and so on. It has now been found that the controlled, deliberate grain growth heat-treatment of fine-grained, highly pure electrodeposited materials (e.g., copper or nickel) results in improved high strain rate ductility when compared to conventional materials.

Applicant's teachings are also particularly suited to the fabrication of articles whose performance is influenced in some way by preferred crystallographic orientation. In some particular examples, metallic articles produced in accordance with the applicant's teaching can be used as sputter targets. Generally speaking, electroformed metals or alloys may not sufficiently satisfy the demands for use as sputter targets because they are either: fine-grained but unsuitable for use as sputter targets because they result in unacceptable chemical contamination of the sputtered film; or of high purity but highly textured or excessively coarse-grained and therefore unsuitable for use as sputter targets because their performance with respect to sputtered film quality, sputter uniformity and overall target lifetime is diminished. It has now been found that the controlled, deliberate heat-treatment of fine-grained, highly pure electrodeposited sputter targets results in improved sputter uniformity, overall target lifetime, uniformity of sputtered film quality, and uniformity of sputtered film sheet resistance.

Articles in accordance with the applicant's teaching can find use in a variety of applications requiring enhanced mechanical isotropy and resistance to grain boundary-mediated degradation mechanisms. Specific application areas include high strength creep-resistant and fatigue-resistant electrical wire, improved intergranular stress corrosion cracking of nickel alloys in high temperature nuclear steam generator environments, other high temperature heat exchangers in the petrochemical industry and high temperature creep-resistant materials in gas turbine applications.

It should be appreciated that aside from fabricating articles that exhibit microstructural improvements throughout the bulk of the component microstructure, the teachings herein can be directed to preparing articles employing a near-surface treatment (e.g., to a depth of between 0.0002 and 0.1 inches) for the creation of functionally graded materials wherein the outer 'skin' and the bulk interior exhibit differing microstructural characteristics (e.g., fraction of special grain boundaries). In some examples, a metallic, ceramic or polymeric component and can be plated at least partially with a metal or alloy that possesses a fine-grained microstructure. Subsequent to plating, part of or the entire component can be exposed to a grain growth heat-treatment at a temperature and time sufficient to induce a desirable increase in the fraction of special grain boundaries in at least a portion of the near-surface region of the component, thereby rendering the near-surface region of the component with improved physical or mechanical properties. Furthermore, surface-specific heat-treatment techniques, such as induction heating, can be suitable for heating the surface of a component to enhance the special grain boundary fraction and/or texture intensity in the outer surface of the metallic material without significantly affecting the microstructure of its core. Other specific heat-treatment techniques that can be used to achieve grain growth in the near-surface layer or selected portions of the plated article only include local heating by a light source, i.e., by a laser treatment. In this manner, the microstructure of the interior of the plated component can remain substantially unaffected by the heat-treatment while the near-surface region undergoes controlled grain growth as described in accordance with the applicant's teachings.

In summary, this specification discloses processes for the preparation of polycrystalline metallic materials that exhibit reduced mechanical and physical anisotropy and enhanced resistance to intergranular-mediated degradation, this improved performance being attributable to factors including an optimized microstructure that exhibits the following characteristics:

- an increase in the fraction of 'special' grain boundaries of at least 0.3, with an overall total 'special' grain boundary fraction in some examples of between 50 and 100%; and
- a crystallographic texture intensity value less than 7.5 times random, and preferably less than 5 times random.

In order to effect the formation of a material that exhibits these characteristics, the general process in accordance with the applicant's teachings can include, as a first step, depositing a metallic material to be used as a precursor. By controlling the processing conditions used to form the precursor, the precursor material can exhibit the following general characteristics:

- an average grain size between 4 nm and 5 μm;
- sufficient purity to avoid grain boundary embrittlement during grain growth heat-treatment (e.g., less than 20 ppm by weight of S, less than 50 ppm by weight of each impurity element selected from the group consisting of P and O, and less than 300 ppm by weight C); and
- a metallic material layer thickness equal to or greater than approximately 30 times the initial average grain size of the precursor metallic material.

The general process in accordance with the applicant's teachings can include, as a second step, heat treating the precursor material at a temperature between 0.25 and 0.7 $T_m$ K for a time sufficient to induce at least a threefold increase in the grain size of the material. By controlling the temperature and duration of heat-treatment, the microstructure of the metallic material can develop a desirable higher fraction of special grain boundaries and a more randomized crystallographic texture.

Reference is now made to the following examples, which are intended to be illustrative but non-limiting.

Example 1

Outside Purity Window 2.3 mm thick free-standing plates of fine-grained copper precursor material were electroformed on a polished Ti cathode (150 $cm^2$) in a conventional acid sulfate copper bath (60 l tank) containing 6000 molecular weight polyethylene glycol as a grain refiner and using phosphorized copper as the anode material. The plating current was supplied by a DYNANET™ PDPR 40-100-400 (Dynatronix, Amery, Wis., USA) pulse power supply. The electrolyte and the electroplating conditions used, along with chemical analysis data from the resultant electrodeposited material, are indicated in Table 2. A PHILIPS XL-30™ FEGSEM microscope in backscatter electron mode and equipped with TSL Orientation Imaging Microscopy (OIM) software version 5.0 was used to characterize the copper and the results are indicated in Table 3 below. The as-deposited average grain size of the electroformed copper was determined to be in the range of 800 to 900 nm. Individual specimens were then subjected to heat-treatments by immersion in molten salt at 350° C. (0.46 $T_m$ K) for 60, 180, and 600 seconds, respectively. It was observed that the average grain size of this material remained relatively small (~1.7 μm) even after heat-treatment at 350° C. (0.46 $T_m$ K). In addition, the fraction of 'special' grain boundaries increased from 62% in the as-deposited condition to a maximum of only 69% after heat treatment, this being accompanied by an imperceptible change in preferred crystallographic orientation. Further attempts to achieve grain growth by heat-treating at higher temperatures of 400° C. (0.50 $T_m$ K) and 450° C. (0.53 $T_m$ K) were then performed and the results are also contained in Table 3. These heat-treatments yielded similar results to the 350° C. (0.46 $T_m$ K) heat-treatment trials. In other words, no significant change in the grain size, texture intensity, or percentage of 'special' grain boundaries was observed. The microstructural evolution of the copper electrodeposited from the acid sulfate bath may have therefore been impeded by the presence of grain boundary pinning impurity elements originating from the co-deposited polyethylene glycol grain refiner. This contamination may have hindered grain growth in general, and the development of the desired randomized texture and grain boundary character distribution rich in 'special' grain boundaries may have been prevented, as indicated in the $\Delta f_{sp}$ column of Table 3, which illustrates the total $f_{sp}$ increase of the heat-treated material over the non-heat-treated material.

TABLE 2

Bath chemistry and plating conditions used to electroform a fine-grained Cu plate along with the results of the chemical analysis carried out on the plate.

| Bath Chemistry |
|---|
| 150 g/l $CuSO_4$ |
| 190 g/l $H_2SO_4$ |
| 40 mg/l chloride ion |
| 3 g/l PEG MW6000 |
| **Plating Conditions** |
| Electrolyte Temperature: 24° C. |
| pH: 1 |
| Electrolyte Agitation Rate (normalized for cathode area): 47 ml/(min · $cm^2$) |
| Average Current Density ($I_{avg}$) [mA/$cm^2$]: 150 |
| Peak Current Density [mA/$cm^2$]: 300 |
| On Time [msec]: 20 |
| Off Time [msec]: 20 |
| Reverse Pulse On Time [msec]: 0 |
| Reverse Pulse Peak Current Density [mA/$cm^2$]: 0 |
| Plating Time [hr]: 16 |

Material Chemical Analysis

| Element | concentration by weight (ppm) |
|---|---|
| S | <20 |
| P | <50 |
| O | 510 |
| C | 400 |

TABLE 3

Results of OIM analysis of samples cut from an electroformed fine-grained Cu plate and heat treated under varying conditions of temperature and time.

| Post-Plate Heat Treatment (° C.) | Heat Treatment Time (seconds) | Grain size (μm) | Texture Intensity | Total Special (% Σ ≤ 29) | Δfsp |
|---|---|---|---|---|---|
| Room temp (0.22 $T_m$ K) | n/a | 0.9 | 1.7 | 62 | 0 |
| 350 (0.46 $T_m$ K) | 60 | 1.7 | 1.7 | 68 | 0.06 |
| 350 (0.46 $T_m$ K) | 180 | 1.7 | 2.1 | 67 | 0.05 |
| 350 (0.46 $T_m$ K) | 600 | 1.7 | 2.1 | 69 | 0.07 |
| 400 (0.50 $T_m$ K) | 60 | 1.7 | 2.0 | 69 | 0.07 |
| 450 (0.53 $T_m$ K) | 60 | 1.7 | 1.7 | 68 | 0.06 |

Example 2

Figure 1:
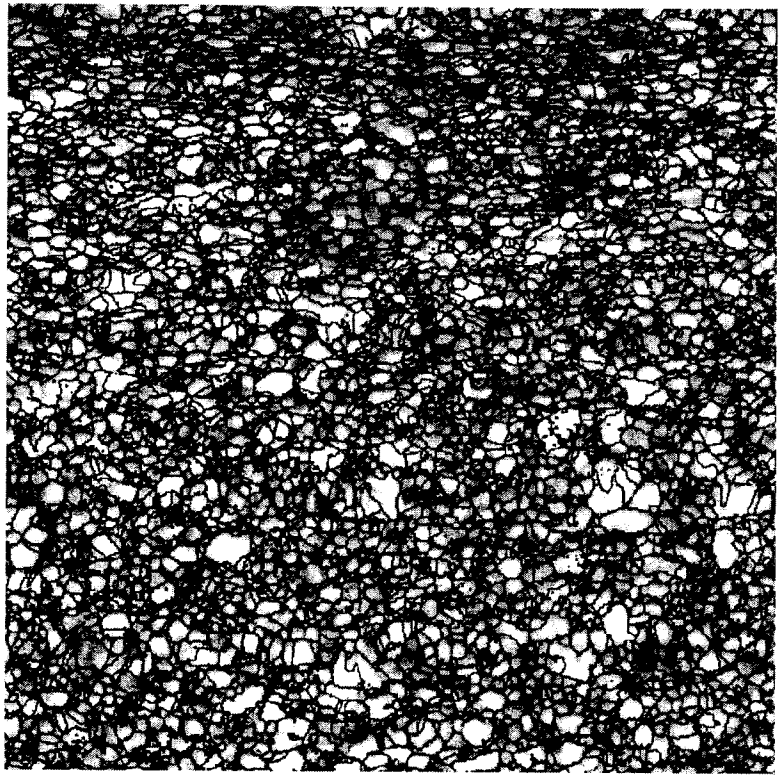
FIG. 1 is an Orientation Imaging Microscopy (OIM) micrograph of copper after electrodeposition, in accordance with Example 2 described in this specification.
Figure 4:
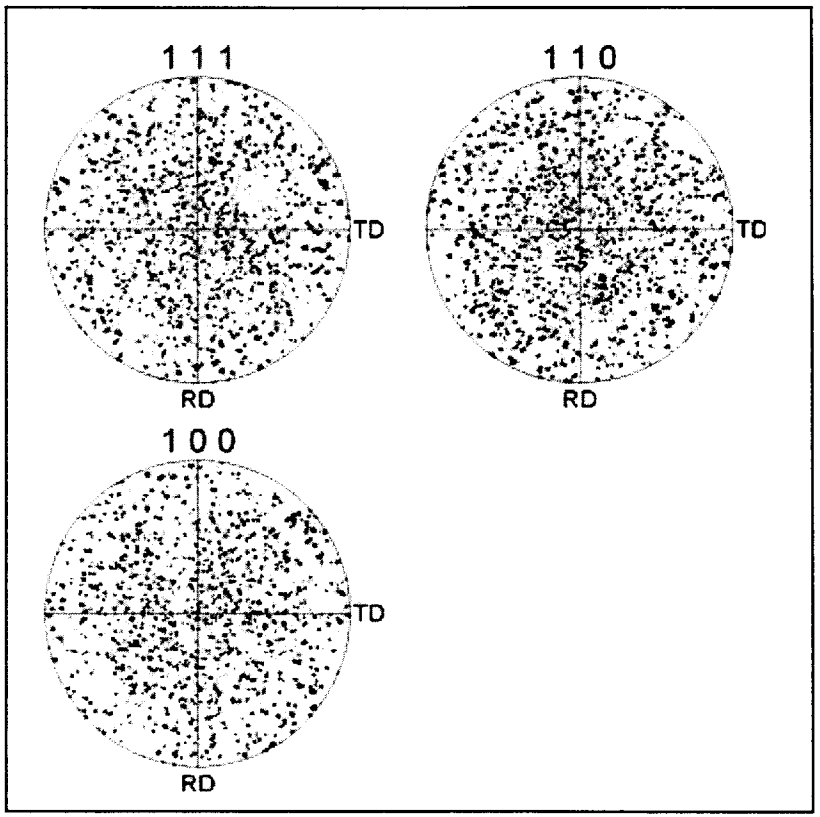
FIG. 4 is an Orientation Imaging Microscopy (OIM) pole figure of an electrodeposited copper microstructure after grain growth heat-treatment, in accordance with Example 2 described in this specification.
Figure 3:
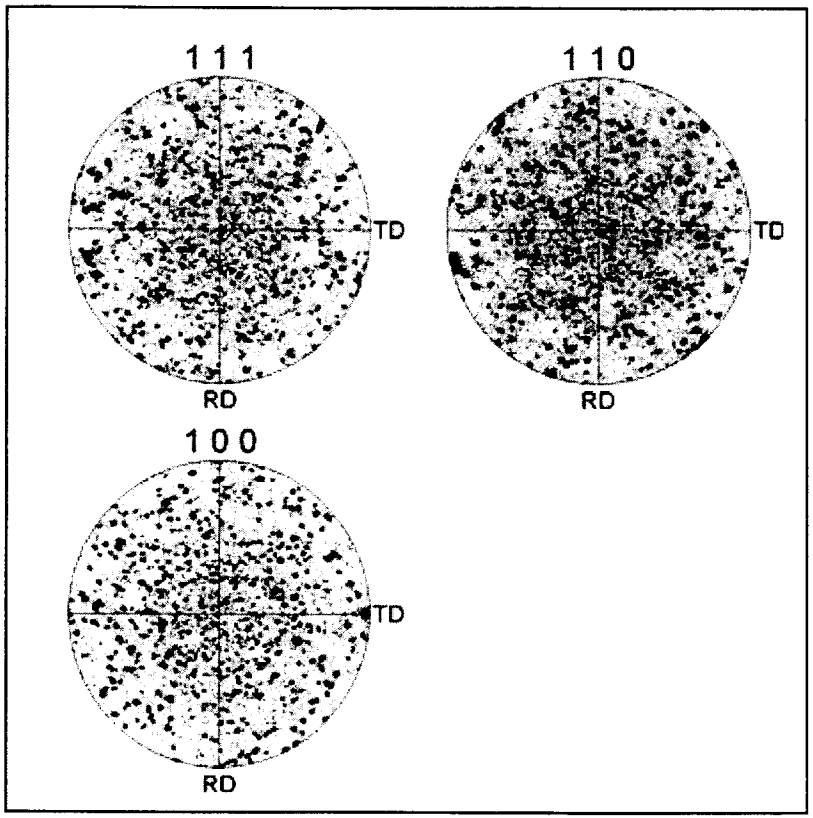
FIG. 3 is an Orientation Imaging Microscopy (OIM) pole figure of copper 8 weeks after electrodeposition, in accordance with Example 2 described in this specification.

A 0.5 mm thick free-standing plate of fine-grained copper precursor material was electroformed on a polished Ti cathode (150 $cm^2$) in a copper pyrophosphate-based bath (60 l tank) using OFHC copper as the anode material. The plating current was supplied by a DYNANET™ PDPR 40-100-400 (Dynatronix, Amery, Wis., USA) pulse power supply. The electrolyte and the electroplating conditions used are indicated in Table 4. Results of chemical assaying of this electrodeposited precursor material are also contained in Table 4. The evolution of the grain boundary character distribution, grain size, and preferred crystallographic orientation were evaluated using the same Orientation Imaging Microscopy (OIM) method described earlier and the results are indicated in Table 5 below. FIG. 1 is an OIM micrograph illustrating the pure copper microstructure immediately after electrodeposition. The as-deposited average grain size of the electroformed copper was determined to be in the range of 200 to 400 nm. The ratio of thickness to grain size was determined to be in the range of 1250 to 2500. Immediately after plating, two samples were cut from the copper plate and one of these samples was immersed for 2 minutes in a molten salt bath heated to 300° C. (0.42 $T_m$ K). An OIM micrograph of this heat-treated microstructure is indicated in FIG. 2. The second sample cut from the copper plate was not heat-treated. Owing to the fact that this fine-grained copper sample in the as-deposited condition was relatively free of grain boundary pinning impurity elements S, P, O and C, room temperature grain growth took place and was permitted to proceed unimpeded for a period of 8 weeks after electroforming. It can be seen that the use of a controlled, deliberate grain growth heat-treatment treatment at a relatively high temperature (300° C.=0.42 $T_m$(K)) for a short period of time (2 minutes) resulted in more effective sustained replacement of higher energy 'general' grain boundaries with 'special' grain boundaries having greater atomic order approaching that of the crystal itself, this ultimately being manifested in a higher fraction of special grain boundaries ($\Delta f_{sp}$=0.37) in the heat-treated sample as compared to the "room temp annealed" specimen ($\Delta f_{sp}$=0.26). Moreover, as is evident from inspection of the pole figures generated by the OIM software corresponding to these two samples, found in FIGS. 3 and 4, the 300° C. (0.42 $T_m$ K) heat-treatment yielded a microstructure exhibiting a more homogeneous, randomized crystallographic texture as compared to the uncontrolled room temperature annealed sample. This randomization of texture is also reflected in the Texture Intensity (TI) values found in Table 5, which show that the controlled 300° C./2 minute heat-treatment resulted in a material exhibiting a texture intensity value less than 5 times random whereas the "room temperature annealed" sample did not.

TABLE 4

Bath chemistry and plating conditions used to electroform a fine-grained Cu plate along with the results of the chemical analysis carried out on the plate.

| Bath Chemistry |
|---|
| 90 g/l $Cu_2P_2O_7$•$4H_2O$ |
| 400 g/l $K_4P_2O_7$ |
| 51 g/l $KH_2PO_4$ |
| 47 g/l KOH |
| 15 g/l $KNO_3$ |
| 8.1 g/l $NH_4OH$ |
| $H_4P_2O_7$ to adjust pH |
| Wetting agents, stress relievers |
| **Plating Conditions** |
| Electrolyte Temperature: 50° C. |
| pH: 8.5 |
| Electrolyte Agitation Rate (normalized for cathode area): 47 ml/(min · $cm^2$) |
| Average Current Density ($I_{avg}$) [mA/$cm^2$]: 35 |
| Peak Current Density [mA/$cm^2$]: 70 |
| On Time [msec]: 20 |
| Off Time [msec]: 20 |
| Reverse Pulse On Time [msec]: 0 |

TABLE 4-continued

| Bath chemistry and plating conditions used to electroform a fine-grained Cu plate along with the results of the chemical analysis carried out on the plate. | |
|---|---|
| Reverse Pulse Peak Current Density [mA/cm$^2$]: 0<br>Plating Time [hr]: 16 | |
| Material Chemical Analysis | |
| Element | concentration by weight (ppm) |
| S | 8.8 |
| P | <50 |
| O | <50 |
| C | 121 |

TABLE 5

Results of OIM analysis of samples cut from an electroformed fine-grained Cu plate, one sample having been analyzed immediately after electrodeposition, a second sample analyzed 8 weeks after electrodeposition, and a third sample analyzed after having been heat-treated immediately after electrodeposition.

| Post-Plate Heat Treatment | Grain size (μm) | Texture Intensity | Total Special (% Σ ≤ 29) | Δfsp |
|---|---|---|---|---|
| None | 0.2-0.4 | 8.3 | 40 | 0 |
| Room temp (0.22$T_m$ K)/8 weeks | 4 | 5.9 | 66 | 0.26 |
| 300° C. (0.42$T_m$ K)/2 minutes | 3 | 4.2 | 77 | 0.37 |

Example 3

Figure 5:
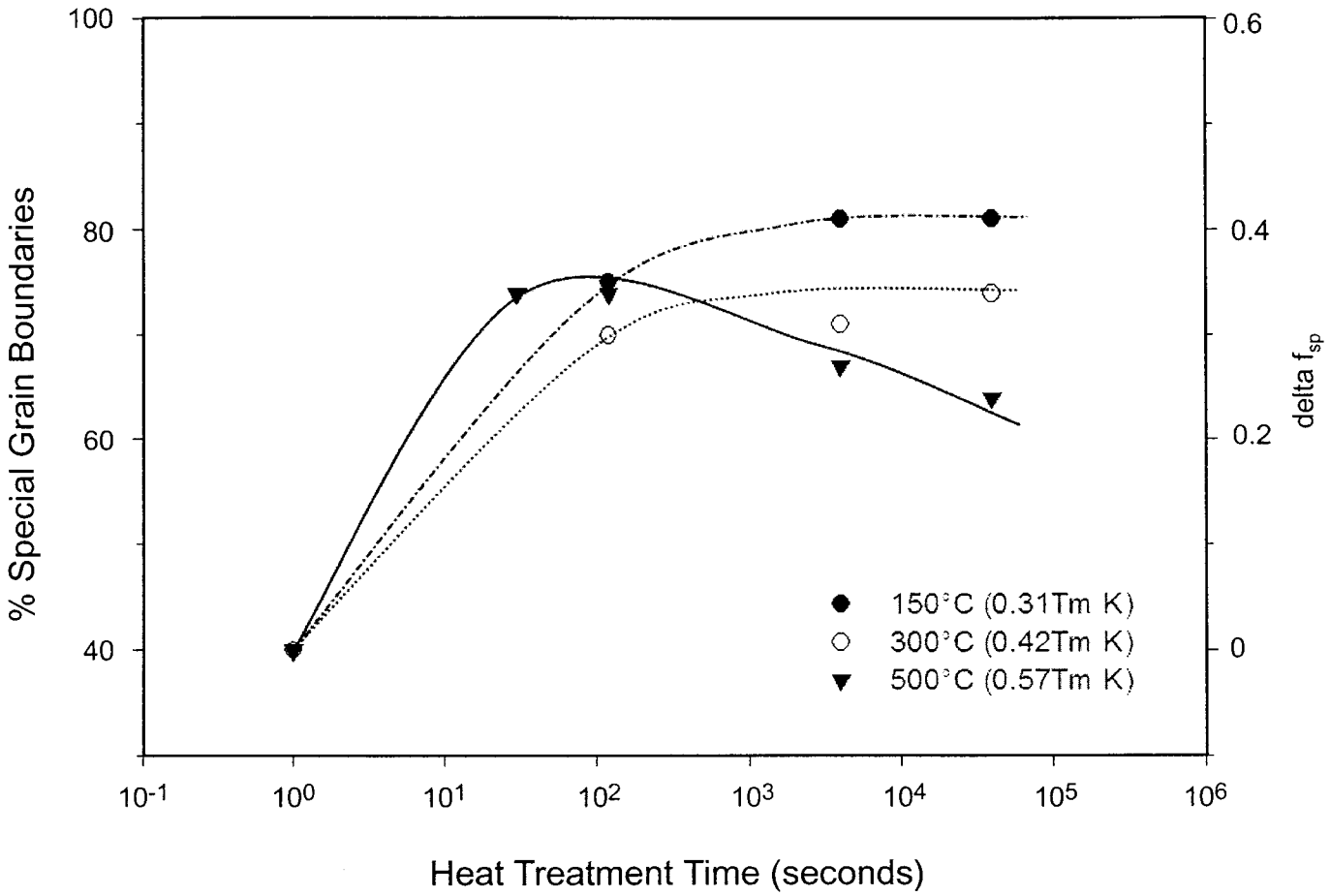
FIG. 5 is a graphical comparison of the 'special' grain boundary content ($f_{sp}$) of electrodeposited copper after grain growth heat-treatments at 150° C., 300° C. and 500° C. for varying durations, in accordance with Example 3 described in this specification.
Figure 6:
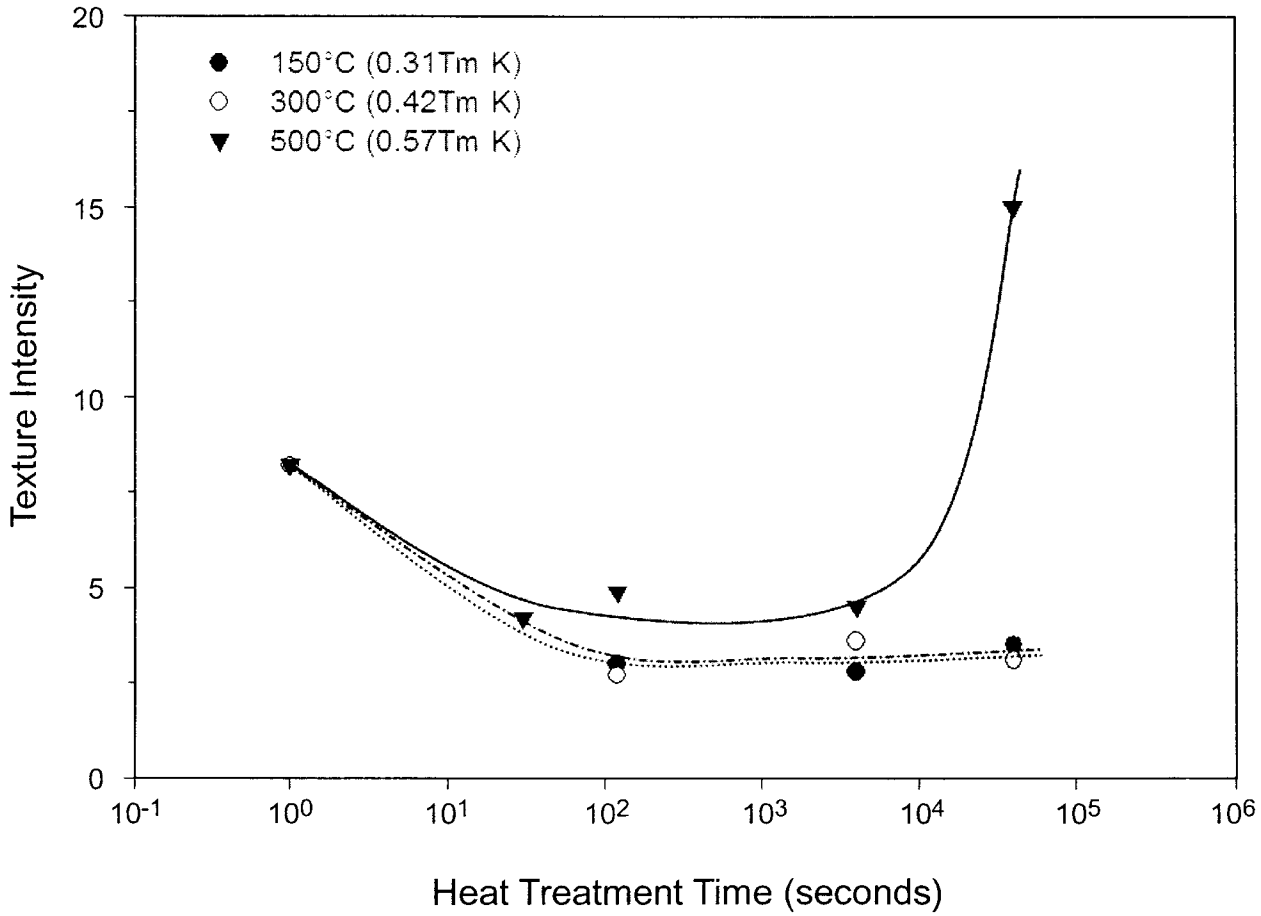
FIG. 6 is a graphical comparison of the Texture Intensity values of electrodeposited copper after grain growth heat-treatment at 150° C., 300° C. and 500° C. for varying durations, in accordance with Example 3 described in this specification.

A 0.5 mm thick free-standing plate of fine-grained copper precursor material was electroformed in the same fashion to that described in Example 2. Chemical assay results of this material are shown in Table 6. The as-deposited average grain size of the electroformed copper was measured in Example 2 to be in the range of 200 to 400 nm and the ratio of thickness to grain size was determined in Example 2 to be in the range of 1250 to 2500. Because the materials were produced in the same fashion, the as plated grain size $f_{sp}$ and texture intensity value data for Example 2 is assumed to be the same for the present example. Individual specimens cut from this plate were then subjected to grain growth heat-treatments by immersion in molten salt at 150° C. (0.31 $T_m$ K), 300° C. (0.42 $T_m$ K), and 500° C. (0.57 $T_m$ K) for times ranging from 30 to 40,000 seconds. The evolution of the grain boundary character distribution, preferred crystallographic orientation and grain size were evaluated using the same Orientation Imaging Microscopy (OIM) method described earlier and the results are indicated in Table 7. In addition, the same $f_{sp}$ and $\Delta f_{sp}$ data are presented schematically in FIG. 5 while the Texture Intensity data for the same samples are presented in FIG. 6. Data for the as-deposited material is included at the 1 second mark on the absissae of FIGS. 5 and 6 for illustrative purposes. Specifically to Table 7 and FIGS. 5 and 6, it can be seen that at grain growth heat-treatment temperatures of 0.31 $T_m$ K and 0.42 $T_m$ K, grain growth heat-treatment for a duration of 120 sec results in significant increases in the material $f_{sp}$ from 40% to 75% (0.31 $T_m$ K) and 70% (0.42 $T_m$ K). The corresponding texture intensity values dropped from 8.2 to 3.0 (0.31 $T_m$ K) and 2.7 (0.42 $T_m$ K) and the average grain size values increased from 0.5 micron to 1.5 micron (0.31 $T_m$ K) and 2 micron (0.42 $T_m$ K). Further increases in the grain growth heat-treatment time resulted in the $f_{sp}$ leveling off at $f_{sp}$=81% (0.31 $T_m$ K) and $f_{sp}$=71 to 74% (0.42 $T_m$ K) with corresponding texture intensity values of 3.5 (0.31 $T_m$ K) and 3.1 (0.42 $T_m$ K) and average grain size values of 2 micron (0.31 $T_m$ K) and 2.8 micron (0.42 $T_m$ K), respectively. In the case when a grain growth heat-treatment temperature of 0.57 $T_m$ K is selected, a $f_{sp}$ maximum of 74% is achieved at a grain growth heat-treatment time of between 30 and 120 sec with a corresponding texture intensity value between 4.2 and 4.9 and an average grain size between 4.1 and 4.4 μm. Extending the grain-growth heat-treatment time beyond 120 seconds at 0.57 $T_m$ K results in a decreased $f_{sp}$ while the texture intensity value ultimately increases to 15 and the average grain size ultimately increases to 7 μm. This example illustrates how grain growth heat-treatment temperature and time parameters can be appropriately determined for achieving the desired special grain boundary fraction, texture intensity values and average grain size values. Similar results are to be expected when the metallic material comprises Ni or Fe or alloys of Cu, Ni and Fe.

TABLE 6

Results of chemical analysis carried out on the Example 3 precursor material.
Material Chemical Analysis

| Element | concentration by weight (ppm) |
|---|---|
| S | <5 |
| P | <5 |
| O | <20 |
| C | <20 |

TABLE 7

Results of OIM analysis of samples cut from an electroformed fine-grained Cu plate and heat treated at varying temperatures and times.

| Post-Plate Heat Treatment | Grain size (μm) | Texture Intensity | Total Special (Σ ≤ 29) | Δfsp (%) |
|---|---|---|---|---|
| None | 0.5 | 8.2 | 40 | 0 |
| 150° C. (0.31$T_m$ K)/120 seconds | 1.5 | 3.0 | 75 | 0.35 |
| 150° C. (0.31$T_m$ K)/4000 seconds | 1.8 | 2.8 | 81 | 0.41 |
| 150° C. (0.31$T_m$ K)/ 40000 seconds | 2.0 | 3.5 | 81 | 0.41 |
| 300° C. (0.42$T_m$ K)/120 seconds | 2.0 | 2.7 | 70 | 0.30 |
| 300° C. (0.42$T_m$ K)/4000 seconds | 2.7 | 3.6 | 71 | 0.31 |
| 300° C. (0.42$T_m$ K)/ 40000 seconds | 2.8 | 3.1 | 74 | 0.34 |
| 500° C. (0.57$T_m$ K)/30 seconds | 4.1 | 4.2 | 74 | 0.34 |
| 500° C. (0.57$T_m$ K)/120 seconds | 4.4 | 4.9 | 74 | 0.34 |
| 500° C. (0.57$T_m$ K)/4000 seconds | 4.8 | 4.5 | 67 | 0.27 |
| 500° C. (0.57$T_m$ K)/ 40000 seconds | 7.0 | 15 | 64 | 0.24 |

Example 4

Free-standing plates of fine-grained copper precursor material were electroformed to varying thickness values in the same fashion to that described in Example 2. Plating time was used to control plated thickness. Chemical assay results of material produced under these conditions are shown in Table 8. The as-deposited average grain size of the electroformed copper was measured to be 600 nm. Using the data as determined for the material of Example 2, the as-deposited $f_{sp}$ was 40% while the TI value was 8.3. Individual specimens were then subjected to grain growth heat-treatments by immersion in molten salt at 300° C. (0.42 $T_m$ K) for 120 seconds. The evolution of the grain boundary character distribution, preferred crystallographic orientation and grain size were evaluated using the same Orientation Imaging Microscopy (OIM) method described earlier and the results are indicated in Table 9. It can be seen that the thin foils (<20 μm) with a thickness/average grain size ratio of less than 30 did not exhibit the desired $f_{sp}$ increase of more than 0.3. On the other hand, the thickness/average grain size ratio of the 100 μm thick sample was determined to be 59, while the thickness/average grain size ratio of the 500 μm thick sample was determined to be 250. After heat-treatment, the 100 and 500 μm thick samples exhibited the desired $f_{sp}$ increase of 0.37 and 0.45, respectively. Similar results are to be expected when the metallic material comprises Ni or Fe or alloys of Cu, Ni and Fe.

TABLE 8

Results of chemical analysis carried out on the Example 4 precursor material. Material Chemical Analysis

| Element | concentration by weight (ppm) |
|---|---|
| S | 0.2 |
| P | 3.1 |
| O | <20 |
| C | <20 |

TABLE 9

Results of OIM analysis of electroformed fine-grained Cu plates of varying thickness heat treated at 300° C. (0.42 $T_m$ K) for 120 seconds.

| Thickness (μm) | Grain size (μm) | Thickness/ Grain Size | Texture Intensity | Total Special (% Σ ≤ 29) | Δfsp |
|---|---|---|---|---|---|
| 10 | 1.0 | 10 | 2.2 | 61 | 0.21 |
| 16 | 1.2 | 13 | 2.5 | 64 | 0.24 |
| 100 | 1.7 | 59 | 3.2 | 77 | 0.37 |
| 500 | 2.0 | 250 | 2.8 | 85 | 0.45 |

Example 5

Two 5.3 mm thick fine-grained sputter targets, labeled "A" and "B", were electroformed on a polished Ti cathode (25 $cm^2$) in a copper pyrophosphate-based bath (60 l tank) using OFHC copper as the anode material. The plating current was supplied by a DYNANET™ PDPR 40-100-400 (Dynatronix, Amery, Wis., USA) pulse power supply. The electrolyte and the electroplating conditions used to produce both along with results of chemical assaying of one of these electrodeposited sputter targets are contained in Table 10. Using the data as determined for the material of Example 2, the as-deposited $f_{sp}$ was 40% while the TI value was 8.3, however the impurity levels achieved were lower due to improved purification via dummying of the sputter target electrodeposition process chemistry. Immediately after plating, both targets were immersed for 2 minutes in a molten salt bath heated to 300° C. (0.42 $T_m$ K). The aforementioned FEGSEM microscope was then used to characterize the average grain size, crystallographic texture, and frequency of 'special' (Σ≤29) grain boundaries of the targets and the results of this analysis are indicated in Table 11.

A conventionally-prepared, commercially available copper sputter target was procured and copper films were sputtered onto silicon wafers using both targets "A" and "B" alongside the commercially available polycrystalline Cu target in an identical manner. The back of the targets were treated with APIEZON L™ vacuum grease in order to seal the O-ring for water cooling. The silicon wafers were then oxidized and cleaned prior to the deposition. There was an initial burn time on all the targets prior to deposition on the silicon wafers. The size of the silicon wafers was 100 mm diameter. The film sputtering conditions were: Sputter Pressure=3 mT; DC Sputter Power=100 W; DC Sputter Current=0.19-0.23 A; and DC Sputter Voltage 420-550 V. The bias voltage was kept constant at −70V for all of the deposition runs. Target thickness for deposition was 100 nm. After sputtering, the films sputtered using the electrodeposited targets "A" and "B" were characterized and the results compared to the film sputtered using the conventional target. This characterization of the films was accomplished by 49 point sheet resistance measurements which were made on the sputtered films using a standard resistivity mapping system.

Figure 7C:
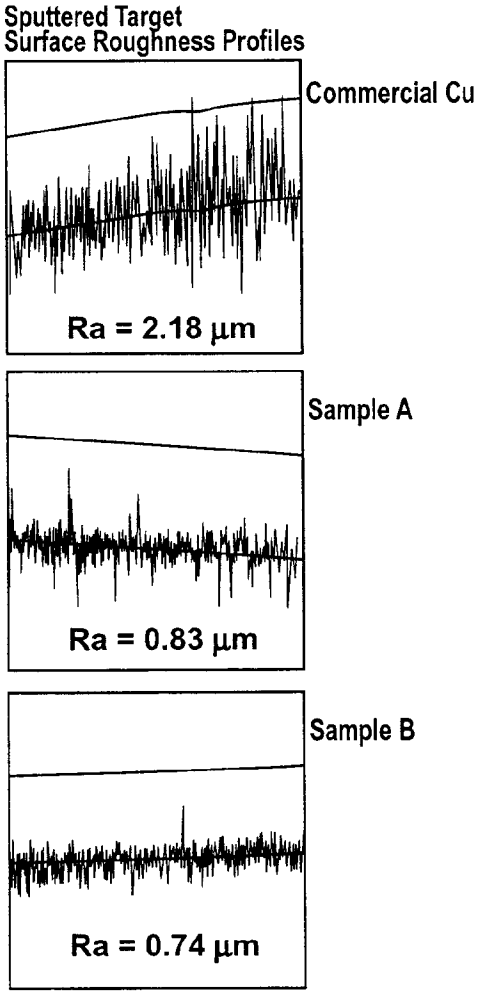
FIG. 7C is a surface profilometer scan of the surface of a commercial Cu target after sputtering service (top) along with surface profilometer scans of the surfaces of two sample Cu sputter targets prepared by the applicant after equivalent sputtering service (target "A" in middle and target "B" at bottom), in accordance with Example 5 described in this specification.
Figure 7B:
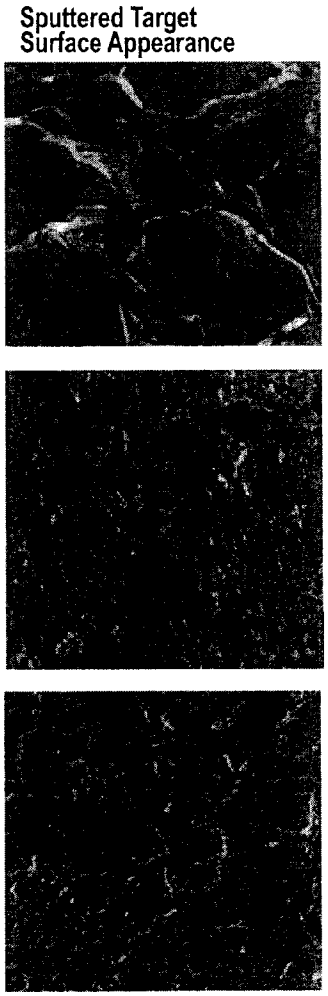
FIG. 7B is a Scanning Electron Microscopy micrograph of a commercial Cu target after sputtering service (top) along with SEM micrographs of the surfaces of two sample Cu sputter targets prepared by the applicant after equivalent sputtering service (target "A" in middle and target "B" at bottom), in accordance with Example 5 described in this specification.
Figure 7A:
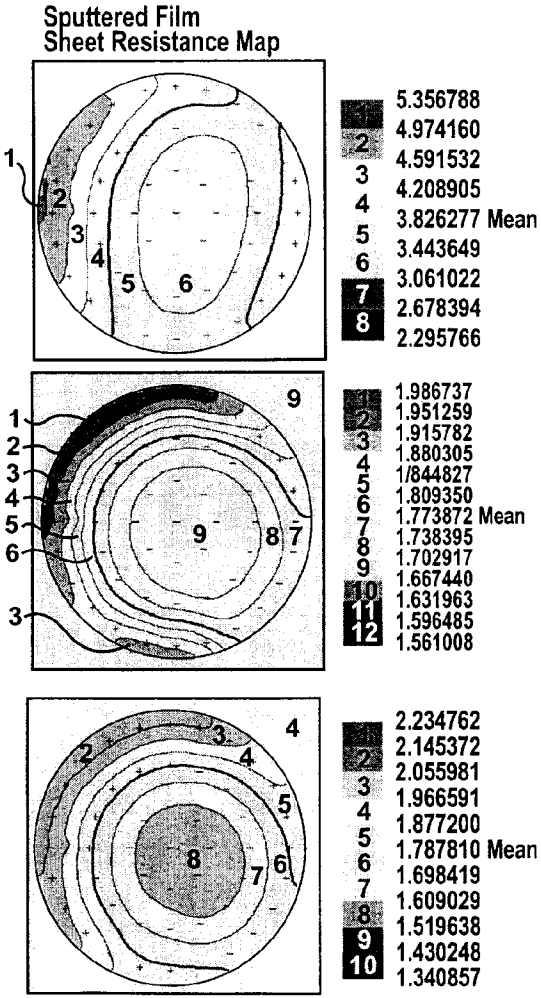
FIG. 7A is a graphical comparison of the sheet resistance of films sputtered using a commercial Cu target (top) along with films sputtered using two sample Cu sputter targets prepared by the applicant (target "A" in middle and target "B" at bottom), in accordance with Example 5 described in this specification.

Under the same sputtering conditions, for a constant average sputtered film thickness of 100 nm, it was observed that the films sputtered using the targets "A" and "B" showed a reduction in the sheet resistance of more than 40% compared to the conventional sputter target. This behavior is evident from the sheet resistance maps contained in FIG. 7A where the sheet resistance of the films sputtered using the electrodeposited targets "A" and "B" have been quantified and benchmarked against the sheet resistance of the film sputtered using the conventional target. The sheet resistance of films sputtered using targets "A" and "B" ranges from approximately 1.3 to 2.3 ohms per square while the sheet resistance of the film sputtered using the benchmark target ranges from 2.3 to nearly 5.4 ohms per square. The numerical scale is given in ohms per square which is the standard unit system for sheet resistance used in the industry.

In addition to sputtered film sheet resistance, the sample sputter targets themselves were inspected by Scanning Electron Microscopy (SEM) after sputtering service. It was found that electrodeposited targets "A" and "B" exhibited improved sputtering target uniformity when compared to the conventional target standard. This behavior is evident from the SEM micrographs of the target surfaces contained in FIG. 7B. Evidence of intergranular degradation, ultimately leading to grain dropping, can be seen in the micrograph of the conventional Cu target surface while this is not observed in the case of the electrodeposited targets "A" and "B". In addition to the SEM micrographs of the target surfaces, the results of surface profilometer measurements made on these same sputter target surfaces after equivalent sputtering service have also been included in FIG. 7C. The average surface roughness of target "A" after sputtering service was measured to be 0.83 μm while that of target "B" was measured to be 0.74 μm, which is an improvement in excess of 60% when compared to the average surface roughness of the standard conventional target after the same extent of sputtering service which was determined to be 2.18 μm. As evidenced by both SEM inspection of the target surfaces after service and the average surface roughness measurements made on these sputter target surfaces, the electrodeposited sputter targets "A" and "B" exhibit an improvement of over 50% of the sputtering uniformity which results in commensurable improved longevity when compared to conventional large-grained, commercially available sputter targets. Similar results are to be expected when the metallic material comprises Ni or Fe or alloys of Cu, Ni and Fe.

TABLE 10

Bath chemistry and plating conditions used to electroform two fine-grained Cu sputter targets along with the results of the chemical analysis carried out on one of the sputter targets.

| Bath Chemistry |
|---|
| 90 g/l $Cu_2P_2O_7 \cdot 4H_2O$ |
| 400 g/l $K_4P_2O_7$ |
| 51 g/l $KH_2PO_4$ |
| 47 g/l KOH |
| 15 g/l $KNO_3$ |
| 8.1 g/l $NH_4OH$ |
| $H_4P_2O_7$ to adjust pH |
| Wetting agents, stress relievers |
| **Plating Conditions** |
| Electrolyte Temperature: 50° C. |
| pH: 8.5 |
| Electrolyte Agitation Rate (normalized for cathode area): 372 ml/(min · $cm^2$) |
| Average Current Density ($I_{avg}$) [$mA/cm^2$]: 35 |
| Peak Current Density [$mA/cm^2$]: 70 |
| On Time [msec]: 20 |
| Off Time [msec]: 20 |
| Reverse Pulse On Time [msec]: 0 |
| Reverse Pulse Peak Current Density [$mA/cm^2$]: 0 |
| Plating Time [hr]: 160 |

Material Chemical Analysis

| Element | concentration by weight (ppm) |
|---|---|
| S | 0.36 |
| P | 1.5 |
| O | 10 |
| C | <20 |

TABLE 11

Results of OIM analysis of electroformed fine-grained Cu sputter targets heat-treated immediately after electrodeposition and a conventional standard sputter target.

| Sputter Target | Grain size (μm) | Texture Intensity | Total Special (Σ ≤ 29) |
|---|---|---|---|
| Sample A/B | 4 | 3.3 | 77 |
| Conventional Standard | 40 | 3.2 | 41 |

Example 6

Figure 9:
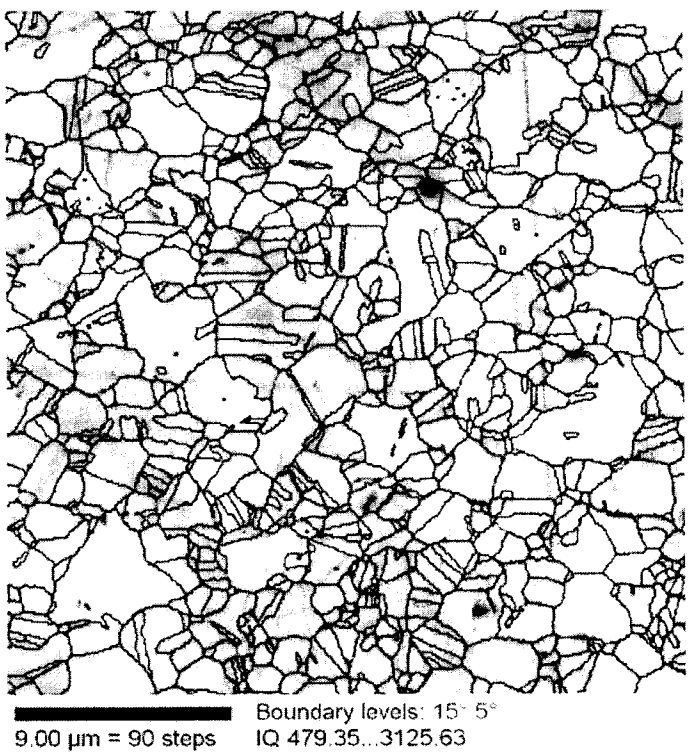
FIG. 9 is an Orientation Imaging Microscopy (OIM) micrograph of an electrodeposited nickel microstructure after grain growth heat-treatment, in accordance with Example 6 described in this specification.
Figure 8:
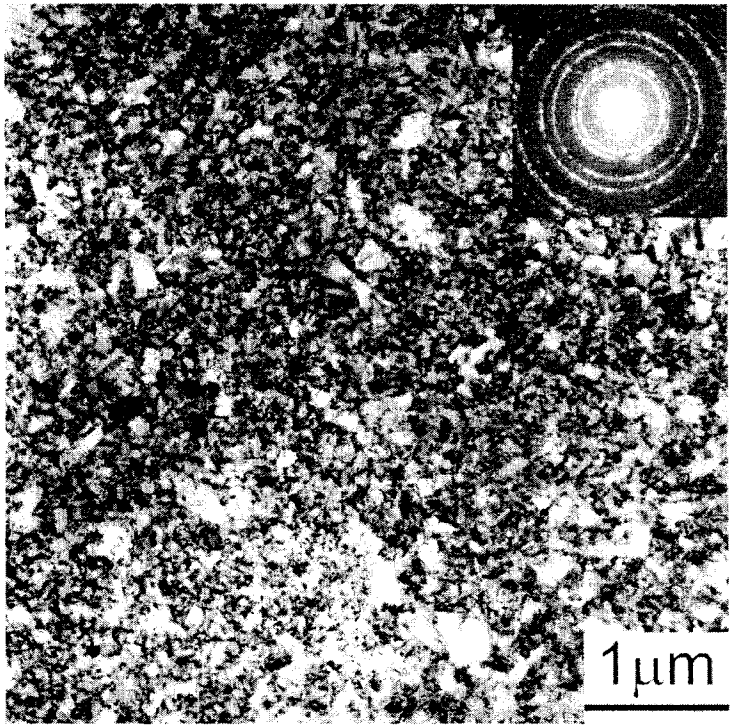
FIG. 8 is a Transmission Electron Microscopy (TEM) micrograph of nickel after electrodeposition, in accordance with Example 6 described in this specification.
Figure 10:
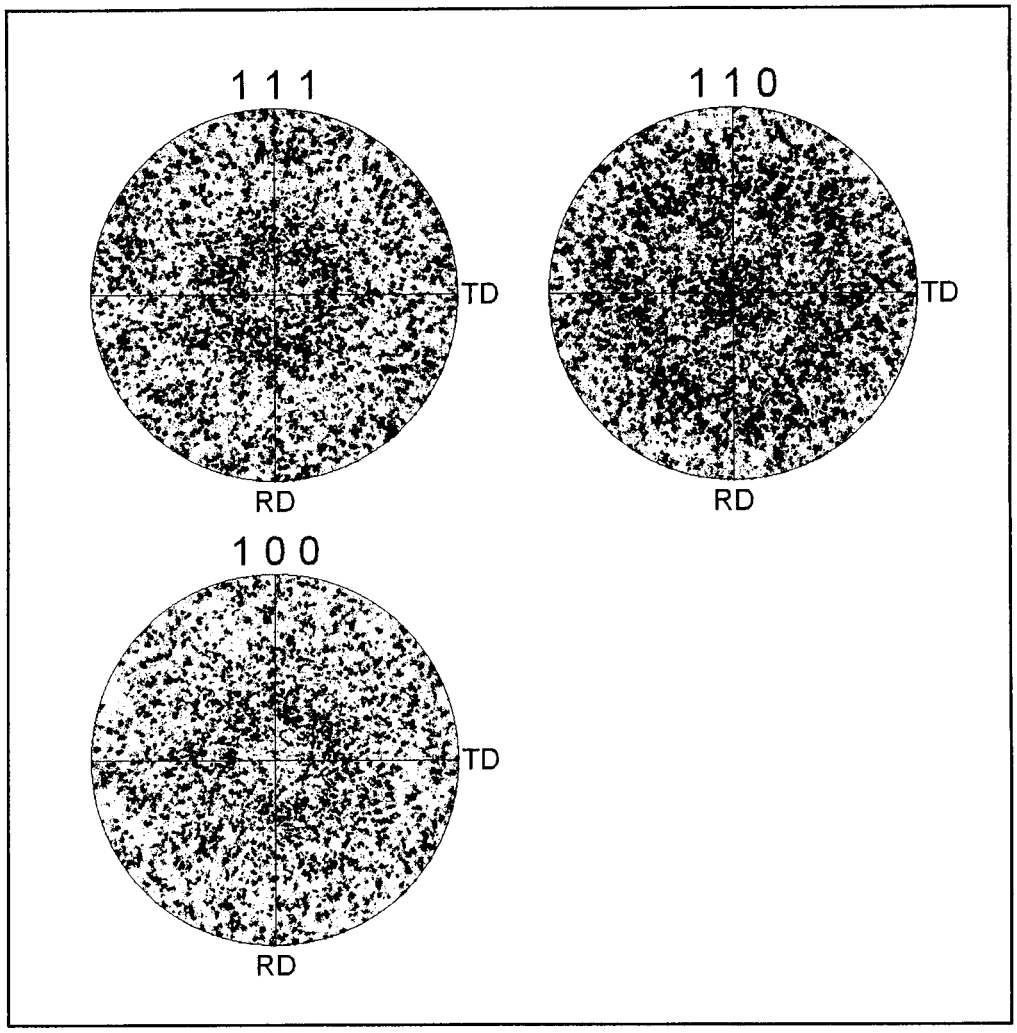
FIG. 10 is an Orientation Imaging Microscopy (OIM) pole figure of an electrodeposited nickel microstructure after grain growth heat-treatment, in accordance with Example 6 described in this specification.

A 0.06 mm thick free-standing plate of fine-grained nickel was electroformed on a polished Ti cathode (10 $cm^2$) in a standard Watts Ni bath (2.5 l tank) without any sulfur-bearing grain refiners and using INCO™ Ni R-rounds as the anode material. The plating current was supplied by an ATC™ 6101 PT (Dynatronix, Amery, Wis., USA) pulse power supply. The electrolyte and the electroplating conditions used are indicated in Table 12 along with results of chemical assaying of the material. The as-deposited microstructure could not be characterized by OIM because the grain size of this material (50 nm) was below the resolution limit of the OIM technique. FIG. 8 is a Transmission Electron Microscopy (TEM) image illustrating the pure nickel microstructure after electrodeposition. The as-deposited average grain size of the electroformed nickel was determined by TEM to be approximately 50 nm. The ratio of thickness to grain size was determined to be about 1200. After plating, a specimen was cut from the nickel plate and heat treated at 800° C. (0.62 $T_m$ K) for 2 minutes. An OIM micrograph of this structure is found in FIG. 9. The grain boundary character distribution, grain size, and preferred crystallographic orientation were evaluated using the same Orientation Imaging Microscopy (OIM) method described earlier and the results are indicated in Table 13 below. For the as-plated sample, the 'special' grain boundary content was estimated to be about 20% (see D. H. Warrington and M. Boon, Acta Metall. 23, 599 (1975) and E. G. Doni, G. Palumbo and K. T. Aust, Scripta Metall. Mat. 24, 2325 (1990)). It can be seen that the use of a controlled, deliberate annealing treatment at a relatively high temperature (800° C.=0.62 $T_m$(K)) for a short period of time (2 minutes) resulted in effective sustained replacement of higher energy 'general' grain boundaries with 'special' grain boundaries having greater atomic order approaching that of the crystal itself, this ultimately being manifested in a high fraction of special grain boundaries ($f_{sp}$=61%) in the sample heat treated at 800° C. (0.42 $T_m$ K). Moreover, as is evident from inspection of the pole figure found in FIG. 10 and the Texture Intensity value (TI=2.7) in Table 13 generated by the OIM software corresponding to this sample, the 800° C. (0.42 $T_m$ K) heat-treatment yielded a microstructure exhibiting a texture intensity value less than 5 times random.

TABLE 12

Bath chemistry and plating conditions used to electroform a fine-grained Ni plate along with the results of the chemical analysis carried out on the plate.

| Bath Chemistry |
|---|
| 300 g/l $NiSO_4 \cdot 6H_2O$ |
| 45 g/l $NiCl_2 \cdot 6H_2O$ |
| 45 g/l $H_3BO_3$ |
| **Plating Conditions** |
| Electrolyte Temperature: 60° C. |
| pH: 4.0 |
| Electrolyte Agitation Rate (normalized for cathode area): 6000 ml/(min · $cm^2$) |
| Average Current Density ($I_{avg}$) [$mA/cm^2$]: 200 |
| Peak Current Density [$mA/cm^2$]: 2000 |
| On Time [msec]: 5 |
| Off Time [msec]: 45 |
| Reverse Pulse On Time [msec]: 0 |
| Reverse Pulse Peak Current Density [$mA/cm^2$]: 0 |
| Plating Time [min]: 20 |

Material Chemical Analysis

| Element | concentration by weight (ppm) |
|---|---|
| S | 10 |
| P | <50 |
| O | <50 |
| C | <100 |

TABLE 13

Results of OIM analysis of samples cut from an electroformed fine-grained Ni plate and heat treated at 800° C. for 2 minutes.

| Post-Plate Heat Treatment | Grain size (μm) | Texture Intensity | Total Special (Σ ≤ 29) | Δfsp |
|---|---|---|---|---|
| none | 0.05 | Not measureable | 20* | 0 |
| 800° C./2 min | 2 | 2.7 | 61 | 0.41 |

While the applicant's teachings are described in conjunction with various embodiments, it is not intended that the applicant's teachings be limited to such embodiments. The applicant's teachings encompass various alternatives, modifications, and equivalents, as will be appreciated by those of skill in the art.

We claim:

1. A method of preparing an article having improved properties, the method comprising the steps of:

a) electrodepositing a metallic material comprising Cu from an alkaline aqueous electrolyte solution containing $KH_2PO_4$ and copper pyrophosphate to form or at least partially plate an article, the as deposited metallic material comprising Cu having i) an average grain size between about 4 nm and 0.5 um, and ii) an impurity content of less than 50 ppm by weight of O; and b) without the application of plastic deformation, heat-treating the electrodeposited metallic material at a temperature between about 0.25 Tm and 0.7 Tm K for a period of time sufficient to induce grain growth in the metallic material such that at least a portion of the metallic material exhibits an increase of at least 0.3 in special grain boundary fraction and a crystallographic texture intensity less than 7.5 times random.

2. The method of claim 1, wherein the heat treatment temperature and time are sufficient to induce at least a three-fold increase in the average grain size of the metallic material.

3. The method of claim 1, wherein the metallic material is electrodeposited to a thickness of at least 30 times the average grain size of the metallic material.

4. The method of claim 1, wherein, after step (b), at least a portion of the metallic material exhibits a special grain boundary content of at least 70%.

5. The method of claim 1, wherein, after step (b), at least a portion of the metallic material exhibits a crystallographic texture intensity less than 5 times random.

6. The method of claim 1, wherein the electrolyte comprises $KNO_3$.

7. The method of claim 1, wherein the electrolyte comprises $NH_4OH$.

8. The method of claim 1, wherein the electrodeposited metallic material has an impurity content of less than 20 ppm by weight of S, less than 50 ppm by weight of P, and less than 300 ppm by weight of C.

* * * * *